US006740462B2

(12) United States Patent
Bartscher et al.

(10) Patent No.: US 6,740,462 B2
(45) Date of Patent: May 25, 2004

(54) METHOD FOR FIXATION OF TONER ON A SUPPORT OR PRINTING STOCK

(75) Inventors: Gerhard Bartscher, Köln (DE); Detlef Schulze-Hagenest, Molfsee (DE); Gerald Erik Hauptmann, Bammental (DE); Frank-Michael Morgenweck, Molfsee (DE); Domingo Rohde, Kiel (DE); Dinesh Tyagi, Fairport, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/023,916

(22) Filed: Dec. 17, 2001

(65) Prior Publication Data

US 2002/0115010 A1 Aug. 22, 2002

(30) Foreign Application Priority Data

Dec. 22, 2000 (DE) ..... 100 64 559

(51) Int. Cl.[7] ..... G03G 13/20

(52) U.S. Cl. ..... 430/124; 430/45; 430/111.4; 399/336

(58) Field of Search ..... 430/124, 111.4, 430/45; 399/336

(56) References Cited

U.S. PATENT DOCUMENTS

| | | | | | |
|---|---|---|---|---|---|
| 4,788,123 | A | * | 11/1988 | Berkes et al. | 430/124 |
| 5,113,223 | A | * | 5/1992 | Theodoulou et al. | 355/285 |
| 5,518,851 | A | * | 5/1996 | Katagiri et al. | 430/110 |
| 6,120,960 | A | | 9/2000 | Aoki et al. | |
| 6,461,782 | B1 | * | 10/2002 | Sasada et al. | 430/109.2 |

FOREIGN PATENT DOCUMENTS

DE 30 17 898 A1 1/1981

* cited by examiner

*Primary Examiner*—John L. Goodrow
(74) *Attorney, Agent, or Firm*—Lawrence P. Kessler

(57) ABSTRACT

A method for fixation of toner on a carrier or printing stock wherein the printing stock with toner is exposed to at least one radiation pulse or radiation flash of electromagnetic radiation and heated for melting of the toner, and a toner having a sharp transition from its solid to liquid state when heated is used. The toner is preferably characterized by the ratio of the value of the elastic modulus G', at the reference temperature value calculated from the initial temperature at the beginning of the glass transition of the toner plus 50° C., to the value of the elastic modulus G' at the initial temperature itself, is less than $10^{-5}$.

16 Claims, 2 Drawing Sheets

METHOD FOR FIXATION OF TONER ON A SUPPORT OR PRINTING STOCK

FIELD OF THE INVENTION

Figure 1:
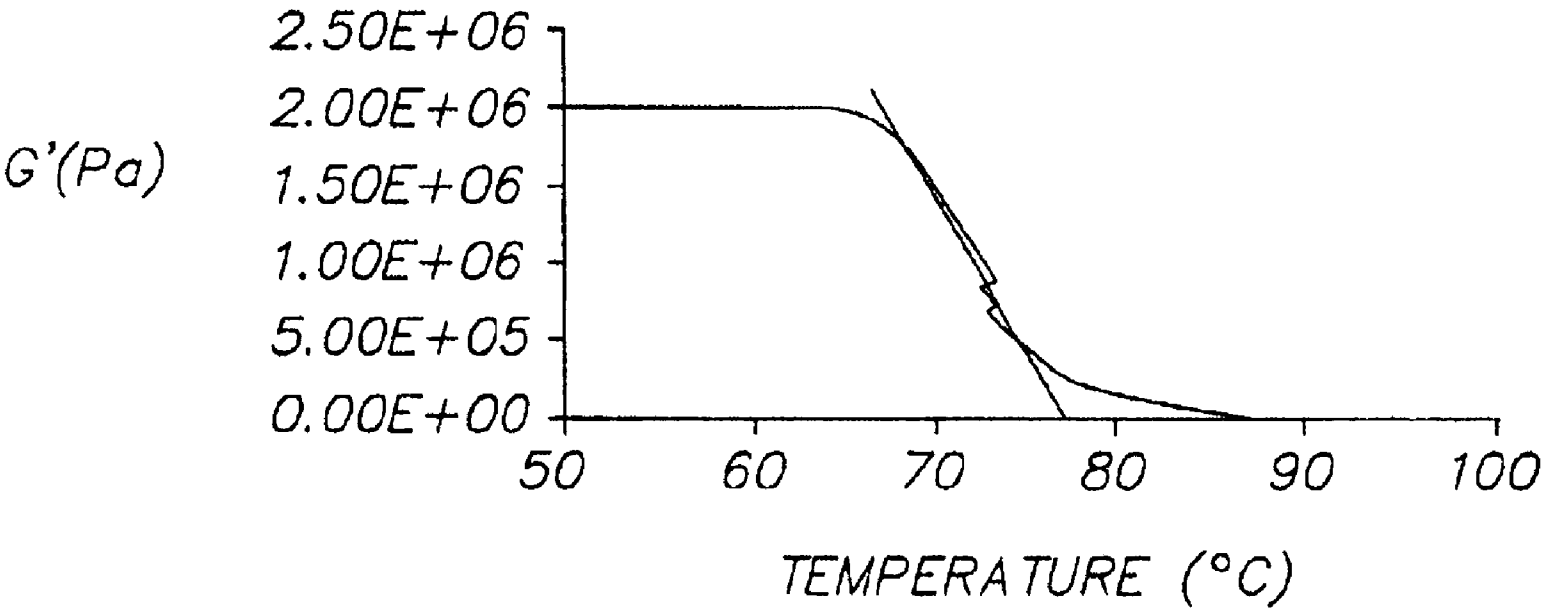

The invention concerns a method for fixation of toner on a support or printing stock, especially a sheet-like printing stock, preferably for a digital printer.

BACKGROUND OF THE INVENTION

In the known method of electrostatic or electrophotographic printing, a latent photostatic image is developed by charged toner particles. These are transferred to a support or substrate that can be referred to in printing terminology as stock. The image transferred to the stock is then fixed, the toner particles being heated and melted. For melting of the toner particles, contact methods are often employed, in which the toner particles are brought into contact with corresponding devices, for example, hot rollers. A shortcoming here is that the design, maintenance and operating costs of these heating devices that operate by contact are demanding and therefore cost-intensive. The use of silicone oil as parting agent is also often required, which is supposed to prevent adherence of the melted toner to the heating device. The error rate caused by the contacting heating devices, especially in the form of paper jams, is also relatively high.

For fixation of the toner transferred to paper, contactless heating devices and methods are also known, in which the toner particles are melted by means of heat and/or microwave radiation or with hot air, so that they adhere to the paper.

A known fixation device is a xenon lamp arranged above the transport path of the paper. Electromagnetic radiation can be applied to the paper, especially in the form of light, by means of a xenon lamp electrically supplied by a power supply unit, so that the toner melts and adheres to the paper surface after cooling. Xenon lamps emit radiation mostly in the visible and near infrared wavelength ranges, in which the toner has high absorption and the paper only limited absorption. This known phenomenon leads to unequal heating of the regions of the toner image having toner densities of different level. In regions of the toner image with limited toner density, in which the toner particles are arranged more or less individually, the toner temperature is much lower than in the regions with higher toner density, because the regions with higher toner density absorb a larger fraction of the electromagnetic radiation. This different absorption behavior leads to unequal melting of the toner image in the regions with different toner density. When the toner image is exposed to such a high energy that the toner is also melted in the regions with low toner density, so-called "microblistering", often occurs in the regions of the toner image with high toner density, i.e., blister formation within the melted toner layer as a result of overheating of the toner and possibly the paper. A drawback here is that the luster of the toner image is influenced by this in an undesired manner. Partial overheating of the paper can also occur, so that it begins to curl.

With unduly low energy, it can happen that, during fixation of the toner, only an incomplete melting of the toner is achieved under some circumstances, depending on its layer thickness. Because of this, adhesion of the toner to the stock, under some circumstances, is insufficient, because the capillary effect of the stock is not adequately utilized owing to the high viscosity of the toner. In particular, problems can occur when a stock is printed on both sides in succession in two steps.

Because of the possible problem just outlined, despite the other drawbacks, the use of radiation alone during fixation is often dispensed with and either an additional heat source is used or the toner is heated without radiation and agglomerated into the stock regularly with a roll under the influence of pressure.

Contactless fixation, however, is desirable, in principle, to protect the printed image. A device for contactless fixation also operates largely free of wear.

SUMMARY OF THE INVENTION

The underlying task of the invention is therefore to make possible adequate contactless fixation of toner on a stock, preferably exclusively by electromagnetic radiation, preferably also for multicolor printing on sheet-like printing stock, in which the regions of the toner image with high and low toner density have at least roughly the same melting and adhesion quality.

For this purpose, it must be briefly described what the term "toner density" is to be understood to mean in connection with the present invention. In color printing, the toner image can have, for example, four toner layers of different color, the toner layers ordinarily being one each of black, yellow, magenta or cyan. The maximum density of each toner layer on the printing stock is 100%, corresponding to a density of about 1.5, measured in transmission, so that a maximum total density of the toner layers of the toner image of 400% is obtained. The density of the toner image ordinarily lies in the range from 10 to 290%. A toner layer with only 10% density is mostly formed by individual toner particles on the printing stock. The energy required to melt a toner image with a density of 10% is much higher than the energy necessary to melt a toner image with a toner density of 400%.

The posed task is solved according to the invention, in terms of the method, in that the printing stock having the toner is exposed to at least one radiation pulse or radiation flash of electromagnetic radiation and is heated for melting of the toner, and that a toner having a sharp transition from its solid to liquid state when heated is used.

In the method according to the invention, for example, a dry toner that is still quite hard at an average temperature of about 80° C. or about 110° C. can be used, so that it can be ground by means of conventional methods to a desired toner size of, say, 8 $\mu$m, and still does not melt even at the development temperatures, but, at higher temperatures of, say, about 110° C. or about 130° C., is already suddenly fluid with low viscosity, so that it deposits on and in the printing stock, optionally with the use of capillarity and without external pressure and without contact, and adheres to it and, on cooling, then becomes hard again very rapidly and is fixed, with good surface luster, especially for lack of formed grain boundaries. The latter plays a significant role for color saturation precisely in color toners.

In conjunction with the toner according to the invention, the ratio of the value of elastic modulus G' at the reference temperature value, calculated from the initial temperature at the beginning of the glass transition of the toner plus 50° C., to the value of the elastic modulus at the initial temperature itself, can be less than $1\times10E^{-5}$, preferably even $1\times10E^{-7}$, in which E stands for a base 10 exponent.

The initial temperature at the beginning of the glass transition of the toner is preferably determined as that temperature value at which the tangent intersects the function of the elastic modulus G' versus temperature before and after the glass transition.

The transition of the toner from its solid to liquid state should preferably occur in a temperature range of about 30° K, preferably in a temperature range from about 70° C. to about 130° C.

In the method according to the invention, at least one radiation pulse of electromagnetic radiation, preferably at least two radiation pulses following each other in time, is used. A second radiation pulse, for example, is triggered when the intensity of the first radiation pulse has diminished to a specific value. The time displacement between two radiation pulses is therefore the duration between triggering of the first radiation pulse and triggering of the second radiation pulse. It has been shown that, by delayed application of the second radiation pulse, the limiting value of the energy at which the toner image is overheated rises. It is therefore possible, according to the invention, for the same energy to be applied for melting of the regions of the toner image with high and low toner density without blister formation occurring in the melted toner layer. The energy of each individual radiation pulse in each case should remain below the limiting energy at which blister formation would occur in the regions of the toner image with higher toner density. The sum of the energy of all radiation pulses is high enough in each case that even regions of the toner image with low toner density are melted in the desired manner and fixed onto the printing stock because of this. With the method according to the invention at least roughly equal melting quality of the regions of the toner image with high and low toner density can be guaranteed. It is also advantageous that adverse effects on the toner image and printing stock as a result of excess heating are avoided.

The energy densities, time spacings and/or pulse lengths in the radiation pulses can be varied with advantage and for adjustment to the corresponding circumstances.

The method according to the invention can be prescribed, in particular, for a multicolor printer. Colored toners, preferably toners of different color, are then used and fixed, one above the other and next to each other, in a toner image.

An absorber, especially for increased absorption of IR or UV light, can additionally be added to the toner.

As already outlined above, a toner with special melting behavior can be used according to the invention. The melting behavior of the toner can be varied or adjusted, in principle, in different ways, for example, the molecular weight distribution or the glass transition point of a toner polymer can be modified, or different mixing ratios of two or more polymers can be chosen. Other additives that influence the melting behavior in different concentrations can also be added, for example, waxes.

DETAILED DESCRIPTION OF THE DRAWINGS

Explanations of the method according to the invention as examples follow, in conjunction with two figures, from which additional inventive expedients are apparent without the invention being limited to the explained examples.

Figure 2:
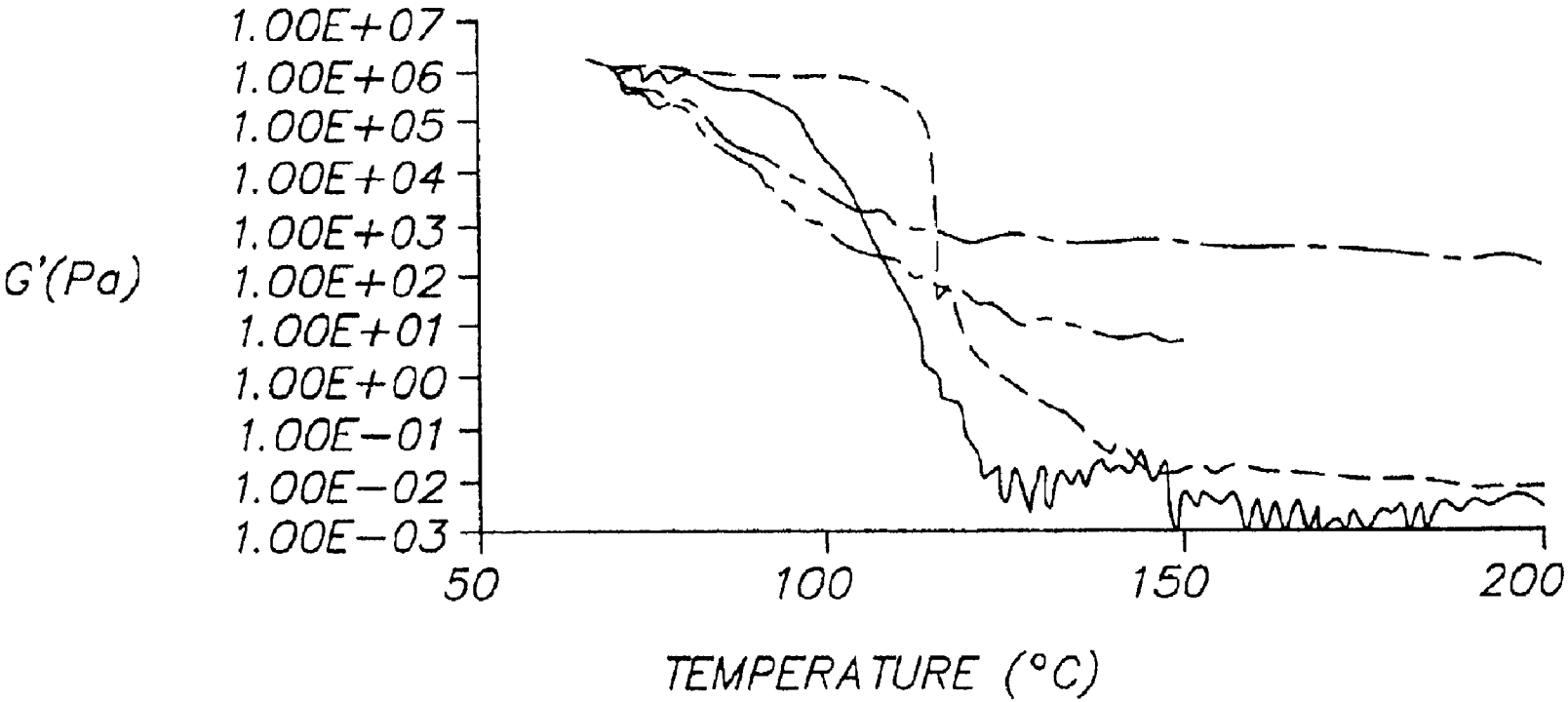

FIG. 1 shows the functional trend of the elastic modulus G' of a toner as a function of temperature for definition of the initial temperature of the glass transition of the toner; and FIG. 2 shows the scanned functional according to FIG. 1 of different toners for comparison.

DETAILED DESCRIPTION OF THE PREFERRED EMBODIMENTS

The G' ratio is the ratio of elastic modulus G' at the initial temperature of the glass transition plus 50° C., to G' at the initial temperature of the glass transition. The initial temperature of the glass transition is determined, according to FIG. 1 from the intersection of the tangent to G' before and after the glass transition and lies at about 70° C. in the depicted example.

The scanned functional trend of G' according to FIG. 1 is shown in FIG. 2 for four toners. The functional values of G' were determined by a theological measurement with a Bolan rheometer, equipped with parallel plates 40 mm in diameter. A temperature scan was conducted at a frequency of 1 rad/s, corresponding to 0.16 Hz between 50° C. and 200° C. The strain of the measurement was chosen so that the sample exhibited no shear dilution (Newtonian behavior).

Only the two toners according to the invention exhibit a sharp transition from the solid to liquid state, with a final G' value of about 1.00E-02. A G' ratio of 5.0E-08 and 2E-8 results from this, with 2.5 ms pulses of the Xe flashbulb. Simultaneous fixation of 10% and 290% surfaces with an energy density of 5.1 and 5.5 J/cm$^2$ was possible in this case.

The two other toners from the prior art show much flatter functional trends of G', with G' ratios of 1.9E-03 and 2.2E-05.

The fixation ratios of the toners according to the invention could not be implemented in these known toners. No simultaneous fixation of 10% and 290% surfaces was possible, but instead the 290% surfaces were already overheated before the 10% surfaces were fixed, because the maximum energy density for 290% surfaces was 4.7 J/cm$^2$ and the minimum energy density necessary for 10% surfaces was 8.3 j/cm$^2$.

The invention has been described in detail with particular reference to certain preferred embodiments thereof, but it will be understood that variations and modifications can be effected within the spirit and scope of the invention.

What is claimed is:

1. Method for fixation of toners on a carrier or printing stock, especially a sheet printing stock, preferably for a digital printer, characterized by the printing stock having the toner being heated with at least one radiation pulse or radiation flash of electromagnetic radiation and heated for melting of the toner, where the ratio of the value of elastic modulus G' at the reference temperature calculated from the initial temperature at the beginning of the glass transition of the toner plus 50° C. to the value of the elastic modulus at the initial temperature being less than $10^{-7}$, whereby the toner has a sharp transition from its solid to liquid state when heated.

2. Method according to claim 1, characterized by the initial temperature at the beginning of the glass transition of the toner being determined as that temperature value at which the tangent intersects the functional trend of the elastic modulus G' as a function of temperature before and after the glass transition.

3. Method according to claim 2, characterized by the transition of the toner from its solid to liquid state occurring in a temperature range of about 30° K. or smaller.

4. Method according to claim 3, characterized by the mentioned temperature range of about 30° K. of the change in state of the toner being situated between the temperature values of about 70° C. and about 130° C.

5. Method according to claim 1, characterized by at least two radiation pulses, offset in time relative to each other, being used for melting of the toner.

6. Method according to claim 5, characterized by the total radiation energy density lying between 1 J/cm$^2$ and 18 J/cm$^2$, preferably between 3 J/cm$^2$ and 10 J/cm$^2$.

7. Method according to claim 5, characterized by the radiation energy density of each radiation pulse being chosen so small that overheating of the toner is avoided.

8. Method according to claim 7, characterized by the radiation energy density of an individual radiation pulse lying between 0.5 and 5 $J/cm^2$.

9. Method according to claim 5, characterized by the time spacing between two consecutive radiation pulses being about 10 to 1000 ms, preferably 200 to 600 ms.

10. Method according to claim 1, characterized by the employed electromagnetic radiation having a significant UV fraction.

11. Method according to claim 10, characterized by the UV fraction being greater than 10%.

12. Method according to claim 11, characterized by a xenon/mercury lamp being used for the radiation.

13. Method according to claim 11, characterized by the radiation being filtered in favor of a higher UV fraction.

14. Method according to claim 1, characterized by color toner, preferably toners of different color, being used and fixed in a toner image, one above the other and next to each other.

15. Method according to claim 14, characterized by at least one toner containing at least one additional absorber for absorption of electromagnetic radiation, preferably a non-visible part of this radiation.

16. Method according to claims 15, characterized by the toners of different color being adjusted to each other by the different absorption properties of the absorber or absorbers.

* * * * *